US008288720B2

(12) United States Patent
Taniguchi

(10) Patent No.: US 8,288,720 B2
(45) Date of Patent: Oct. 16, 2012

(54) ION TRAP MASS SPECTROMETER

(75) Inventor: Junichi Taniguchi, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 0 days.

(21) Appl. No.: 13/219,408

(22) Filed: Aug. 26, 2011

(65) Prior Publication Data

US 2012/0049059 A1 Mar. 1, 2012

(30) Foreign Application Priority Data

Aug. 30, 2010 (JP) ..... 2010-191730

(51) Int. Cl.
*B01D 59/44* (2006.01)
*H01J 49/42* (2006.01)
*H01J 49/40* (2006.01)

(52) U.S. Cl. ..... 250/290

(58) Field of Classification Search ..... 250/281, 250/282, 290–293
See application file for complete search history.

(56) References Cited

U.S. PATENT DOCUMENTS

| | | | | |
|---|---|---|---|---|
| 4,761,545 | A | 8/1988 | Marshall et al. | 250/291 |
| 5,134,286 | A | 7/1992 | Kelley | 250/282 |
| 5,703,358 | A | 12/1997 | Hoekman et al. | 250/282 |
| 6,700,116 | B2 * | 3/2004 | Taniguchi | 250/282 |
| 8,044,349 | B2 * | 10/2011 | Satake et al. | 250/290 |
| 2002/0092980 | A1 * | 7/2002 | Park | 250/288 |
| 2011/0216952 | A1 * | 9/2011 | Kajihara | 382/128 |
| 2011/0303842 | A1 * | 12/2011 | Nakano | 250/288 |

FOREIGN PATENT DOCUMENTS

| | | |
|---|---|---|
| JP | 2001-210268 | 8/2001 |
| JP | 2007-527002 | 9/2007 |
| JP | 2008-282594 | 11/2008 |
| WO | WO 2005/083743 A2 | 9/2005 |

OTHER PUBLICATIONS

Li Ding et al. "Development of Digital Ion Trap Mass Spectrometer", Shimadzu Review, vol. 62, No. 3-4, (Mar. 2006), pp. 141-151.

* cited by examiner

*Primary Examiner* — Bernard E Souw
(74) *Attorney, Agent, or Firm* — DLA Piper LLP (US)

(57) ABSTRACT

A technique for performing precursor isolation with a desired mass-to-charge ratio (m/z) in a digital ion trap while maintaining the q value at a substantially constant value is provided. A data obtained by digitizing an FNF signal having a notch is stored beforehand in an FNF waveform memory 15. In the process of precursor isolation, a main voltage timing controller 7 and a main voltage generator 9 generate a rectangular-wave voltage based on a reference clock signal CK. An auxiliary signal generator 14 reads data from the FNF waveform memory 15 and generates an FNF signal by performing digital-to-analogue conversion of the data in accordance with a clock signal synchronized with the reference clock signal CK. Under the command of a controller 30, a reference clock generator 6 produces the reference clock signal CK having a frequency corresponding to the m/z value of a target ion. Accordingly, a change in the m/z of the target ion leads to a change in the frequency of the reference clock signal CK, which causes the frequency of the rectangular-wave voltage and the central frequency of the notch of the FNF signal to change in the same proportion.

2 Claims, 1 Drawing Sheet

ION TRAP MASS SPECTROMETER

TECHNICAL FIELD

The present invention relates to an ion trap mass spectrometer having an ion trap for capturing an ion or ions by an action of a radio-frequency electric field. More specifically, it relates to an ion trap mass spectrometer using a digitally driven ion trap.

BACKGROUND ART

An ion trap is a device used in a mass spectrometer to capture and confine ions by an action of a radio-frequency electric field, to select an ion having a specific mass-to-charge ratio (m/z), and to dissociate the selected ion into fragment ions. A typical ion trap has a three-dimensional quadrupole structure including a circular ring electrode and a pair of end-cap electrodes facing each other across the ring electrode, where the inner surface of the ring electrode is in the form of a hyperboloid of revolution of one sheet while the inner surfaces of the end-cap electrodes are in the form of a hyperboloid of revolution of two sheets. Another commonly known type of ion trap is a linear type having four rod electrodes arranged parallel to each other. In the present description, the "three-dimensional quadrupole type" is taken as an example for convenience.

A majority of conventional ion traps are analogue-driven ion traps, which will be described later. In an analogue-driven ion trap, a sinusoidal radio-frequency voltage is normally applied to the ring electrode to create an ion-capturing radio-frequency electric field within the space surrounded by the ring electrode and the end-cap electrodes. Due to the action of this radio-frequency electric field, ions are confined in the aforementioned space while oscillating in this space. In recent years, a new type of ion trap, in which a rectangular-wave voltage is applied to the ring electrode in place of the sinusoidal radio-frequency voltage to confine ions, has been developed (for example, see Patent Documents 1, 2 or Non-Patent Document 1). This ion trap normally uses a rectangular-wave voltage having the binary voltage levels of "high" and "low" and is therefore called a Digital Ion Trap (which is hereinafter abbreviated as "DIT").

In an MS/MS analysis performed by an ion trap mass spectrometer using a DIT (which is hereinafter referred to as the "DIT-MS"), after ions within a predetermined mass-to-charge ratio range have been captured into the inner space of the ion trap, a precursor-isolating (selecting) operation for ejecting unnecessary ions from the ion trap must be performed to leave only an ion having a specific mass-to-charge ratio. As described in Non-Patent Document 1, the techniques of precursor isolation in the DIT-MS include high-speed precursor isolation, which is called rough isolation, and high-resolution precursor isolation, which is performed using resonant ejection after the rough isolation.

One advantage of the DIT over the analogue-driven ion trap (hereinafter abbreviated as the "AIT") using a sinusoidal radio-frequency voltage is the high mass-resolving power achieved by resonant ejection. Normally, in the resonant ejection performed in a DIT, a rectangular-wave signal having a single frequency synchronized with the frequency Ω of the rectangular-wave voltage applied to the ring electrode is applied to the pair of the end-cap electrodes, where the aforementioned single frequency is typically obtained by dividing the aforementioned rectangular-wave voltage. In this state, when the frequency Ω of the rectangular-wave voltage applied to the ring electrode is continuously decreased, the ions captured in the ion trap are selectively subjected to resonant excitation in ascending order of their mass-to-charge ratio and ejected from the ion trap. (This operation is called a "forward scan", where an ion having a smaller mass-to-charge ratio is ejected earlier.) Conversely, when the frequency Ω of the rectangular-wave voltage applied to the ring electrode is continuously increased, the ions captured in the ion trap are selectively subjected to resonant excitation in descending order of their mass-to-charge ratio and ejected from the ion trap. (This operation is called a "reverse scan", where an ion having a larger mass-to-charge ratio is ejected earlier.) Accordingly, it is possible to achieve a high level of precursor-isolation power by successively performing the forward scan and the reverse scan so as to leave only an ion having a desired mass-to-charge ratio.

In order to completely remove ions having unnecessary mass-to-charge ratios, it is necessary to hold the frequency Ω for a period of time required to eject those ions from the ion trap. For this purpose, the speed of changing the frequency Ω must be set lower than a certain speed. Therefore, to achieve a sufficient mass-separating power, a period of time equal to or longer than several hundred msec is required for only the precursor isolation. For example, in the case of an MS/MS analysis including the steps of (A) trapping ions within a predetermined mass-to-charge ratio range in the ion trap and cooling them, (B) removing undesired ions by resonant ejection to retain only a precursor ion (the precursor-isolating step), (C) inducing collision dissociation of the precursor ion, and (D) extracting the collision-dissociated ions by resonant ejection and obtaining a mass spectrum, each of the steps (A), (C) and (D) requires a few to several tens of msec. Consuming several hundreds of msec for only step (B) will significantly lower the throughput of the analysis. In recent years, improving the throughput of the mass analysis has been extremely important. Therefore, time reduction of the precursor isolation in the DIT is a critical and unavoidable problem.

In the previously described ion-removing method using a frequency scan, a portion of the ions that are resonantly excited to be ejected from the ion trap may undergo collision-induced dissociation, generating fragment ions having smaller mass-to-charge ratios. Furthermore, although this is a rare case, a multiply-charged ion may turn into an ion having a larger mass-to-charge ratio as a result of charge transfer and dissociation. After unnecessary ions have been removed by a frequency scan to leave an ion with a certain mass-to-charge ratio, if fragment ions or other ions are generated as just described, these ions cannot be removed by the frequency scan and will remain inside the ion trap.

By the way, in the case of AITs, the oscillation frequency of the ions changes depending on the amplitude of the radio-frequency voltage applied to the ring electrode. Based on this relationship, a technique for simultaneously removing various kinds of ions having unnecessary mass-to-charge ratios other than the target ion (precursor ion) has been developed, in which a signal having a broad-band frequency spectrum with a notch (omission) at the oscillation frequency of the target ion is applied to the end-cap electrodes (for example, see Patent Document 3 or 4). One example of the signals commonly used as the aforementioned broad-band signal is a Filtered Noise Field (FNF) signal described in Patent Document 5. Another conventional example is a Stored Wave Inverse Fourier Transform (SWIFT) signal described in Patent Document 6.

To achieve a high level of mass-separating power, it is necessary to perform the precursor isolation with the highest possible q value, which is one of the parameters representing the conditions for the stable capturing of ions. For AITs, the q value is normally set at approximately 0.8. When the q value is fixed, the β value (a parameter associated with the resonance frequency) will also be fixed, whereby the notch frequency of the FNF signal will be uniquely determined. By preparing a dozen or more FNF signal waveforms having different notch widths centered on the notch frequency and storing them in a memory beforehand, it is possible to easily achieve precursor isolation with a given mass width by selecting an appropriate FNF signal waveform for the precursor isolation.

The idea of isolating a precursor ion by using an FNF signal or similar broad-band signal is also applicable to the DIT as well as the MT. It should be noted that, unlike the case of the AIT, the amplitude of the rectangular-wave radio-frequency voltage applied to the ring electrode in the DIT is basically constant; it is the frequency of the rectangular-wave voltage that is changed to control the oscillation frequency of the ions. Accordingly, for the DIT, it is possible to adopt a method in which the notch frequency of the FNF signal applied to the end-cap electrodes is fixed and the frequency of the rectangular-wave voltage applied to the ring electrode is controlled so as to make the oscillation frequency of the target ion correspond to the notch frequency. However, such a control causes the q value used in the precursor-isolating process to change according to the mass-to-charge ratio of the target ion. This is because, as will be described later, the q value is a function inversely proportional to the square of the frequency of the rectangular-wave voltage applied to the ring electrode. Therefore, it is impossible to ensure a sufficiently high mass-separating power under the condition where the q value is decreased.

To avoid such a situation, the q value must be maintained as constant as possible during the precursor-isolating process. For this purpose, when the mass-to-charge ratio of the target ion is changed, it is necessary to change not only the frequency of the rectangular-wave voltage applied to the ring electrode, but also the notch frequency of the FNF signal supplied to the end-cap electrodes in accordance with the change in the frequency of the rectangular-wave voltage. Generating an FNF signal having a large number of frequency components by a computer normally requires a considerable period of time, and it is impractical to generate a required FNF signal waveform on a computer simultaneously while performing an analysis. Therefore, in the case of using an FNF signal in an AIT, an FNF signal waveform that is expected to be required is generated beforehand on a computer and a data representing the waveform is stored in a memory. When an analysis is performed, the data is read from the memory and subjected to digital-to-analogue conversion to produce the FNF signal waveform.

In the case of DITs, as already explained, various FNF signal waveforms with different notch frequencies are required. Therefore, it is necessary to prepare a large number of FNF signal waveform data corresponding to those waveforms and store the data in a memory. For example, to make the notch frequency selectable within a mass-to-charge ratio range from m/z50 to m/z3000 in units of 0.1, it is necessary to prepare approximately 30,000 kinds of different FNF signal waveform data. Furthermore, to enable the selection of various mass-separation widths, it is further necessary to prepare several tens of different waveforms for each value of the notch frequency. As a result, the amount of required FNF signal waveform data will be an enormous number.

BACKGROUND ART DOCUMENT

Patent Document

Patent Document 1: JP-T 2007-527002
Patent Document 2: JP-A 2008-282594
Patent Document 3: JP-A 2001-210268
Patent Document 4: U.S. Pat. No. 5,134,286
Patent Document 5: U.S. Pat. No. 5,703,358
Patent Document 6: U.S. Pat. No. 4,761,545

Non-Patent Document

Non-Patent Document 1: Furuhashi, et al. "Dejitarui Ion Torappu Shitsuryou Bunseki Souchi No Kaihatsu (Development of Digital Ion Trap Mass Spectrometer)", *Shimadzu Hyouran* (*Shimadzu Review*), Shimadzu Hyouron Henshuubu, Mar. 31, 2006, Vol. 62, Nos. 3•4, pp. 141-151

DISCLOSURE OF THE INVENTION

Problem to be Solved by the Invention

The present invention has been developed to solve the aforementioned problems relating to the ion trap mass spectrometer using a DIT. The primary objective of the present invention is to suppress the capacity of the memory for storing waveform data of a broad-band signal, such as an FNF signal, as well as to shorten the period of time for isolating a precursor while ensuring a high precursor-isolating power. Another objective is to prevent the situation where an ion or the like having a smaller mass-to-charge ratio generated in the process of removing unnecessary ions for the purpose of precursor isolation remains in the ion trap without being removed.

Means for Solving the Problems

The present invention aimed at solving the aforementioned problems is an ion trap mass spectrometer having an ion trap for capturing ions into a space surrounded by three or more electrodes including a first electrode, a second electrode and a third electrode, the second electrode and the third electrode facing each other apart from the first electrode, the mass spectrometer capable of resonant ejection of unnecessary ions from among the captured ions by applying a signal for resonant excitation of ions to each of the second and third electrodes while applying an ion-capturing rectangular-wave voltage to the first electrode, and the mass spectrometer including:

a) a data memory for storing a waveform data obtained by digitizing a broad-band signal representing a frequency spectrum having a notch at a predetermined frequency or over a predetermined frequency range;

b) a rectangular-wave voltage generator for generating, in an ion-selecting process for selectively leaving an ion having a specific mass-to-charge ratio or ions belonging to a specific mass-to-charge ratio range in the ion trap, an ion-capturing rectangular-wave voltage adjusted to a frequency corresponding to the aforementioned specific mass-to-charge ratio or mass-to-charge ratio range, and for applying this rectangular-wave voltage to the first electrode; and c) a broad-band signal generator for generating a broad-band signal for resonantly exciting ions, excluding at least the ion having the specific mass-to-charge ratio or the ions belonging to the mass-to-charge ratio range, by sequentially retrieving waveform data stored in the data memory and converting the retrieved data to analogue data at a timing synchronized with the frequency of the rectangular-wave voltage generated by the rectangular-wave voltage generator in the ion-selecting process, and for applying the broad-band signal to the second and third electrodes.

The ion trap used in the ion trap mass spectrometer according to the present invention is a three-dimensional quadrupole ion trap or a linear ion trap. In the case of the three-dimensional quadrupole ion trap, the ring electrode corresponds to the first electrode, while the two end-cap electrodes facing each other across the ring electrode corresponds to the second and third electrodes. In the case of the linear ion trap, which is composed of four rod electrodes arranged parallel to each other around a central axis, two rod electrodes facing each other across the central axis correspond to the first electrode, while the other two rod electrodes respectively correspond to the second and third electrodes.

A typical example of the "broad-band signal representing a frequency spectrum having a notch at a predetermined frequency or over a predetermined frequency range" is the aforementioned FNF signal. However, this is not the only example; any broad-band signal can be used as long as it has a notch at a predetermined frequency or over a predetermined frequency range on the frequency spectrum and includes a number of frequency components. Naturally, there is no specific limitation on the method of producing the notched broad-band signal waveform (e.g. the FNF signal) at a stage before the storage of waveform data in the data memory; there are various conventional methods (algorithms) available for this purpose.

In the ion trap mass spectrometer according to the present invention, when the rectangular-wave voltage generator changes the frequency of the rectangular-wave voltage applied to the first electrode so as to change the mass-to-charge ratio of the ion or the mass-to-charge ratio range of the ions to be left in the ion trap in the ion-selecting process, the notch frequency (central frequency) of the broad-band signal generated by the broad-band generator also changes in the same proportion. Accordingly, it is possible to change the mass-to-charge ratio of the ion to be excluded from the target of resonant ejection, i.e. the ion to be selectively left in the ion trap, while satisfying the condition that the 13 value, which is defined between the envelopes $\beta=0$ and $\beta=1$ of the stability region of the ion trap, is maintained at a substantially constant level. That is to say, it is possible to arbitrarily specify the mass-to-charge ratio of a target ion to be left in the ion trap while maintaining the 13 value (and hence the q value) at a substantially constant level, using only one kind of waveform data stored in the data memory.

In the case of using only one kind of waveform data of the broad-band signal, the mass-separation width of the ion to be selected will be uniquely determined for the mass-to-charge ratio, so that it is impossible to arbitrarily set the mass-separation width. Therefore, when it is desirable to make the mass-separation width selectable from a plurality of values for one mass-to-charge ratio, one waveform data obtained by digitizing a broad-band signal having a notch width corresponding to the mass-separation width is prepared for each value of the mass-separation width. In the ion-selecting process, an appropriate waveform data is selected for the mass-to-charge ratio of a target ion and the required mass-separation width, and a signal obtained by converting the waveform data into analogue form is applied to the second and third electrodes.

In one mode of the present invention, the ion trap mass spectrometer further includes a reference clock signal generator for generating a reference clock signal having a frequency corresponding to the mass-to-charge ratio of an ion or the mass-to-charge ratio range of ions to be left in the ion trap in the ion-selecting process, the rectangular-wave voltage generator generates a rectangular-wave voltage on a basis of the reference clock signal, and the broad-band signal generator generates a broad-band signal by digitizing a waveform data read from the data memory in accordance with the reference clock signal or another clock signal synchronized with the reference clock signal.

By this configuration, both the frequency of the rectangular-wave voltage applied to the first electrode and the notch frequency of the broad-band signal applied to the second and third electrodes can be appropriately set by changing the frequency of one clock signal (e.g. the reference clock signal generated by the reference clock signal generator, or a clock signal generated by dividing the reference clock signal) according to the mass-to-charge ratio of the target ion. For example, using a direct digital synthesizer (DDS) or similar variable frequency signal generator as the reference clock signal generator allows arbitrary and easy setting of the mass-to-charge ratio of the target ion.

The drive control of an ion trap in the ion trap mass spectrometer according to the present invention can be used not only in the ion-selecting process, such as precursor isolation, but also for the drive control of the ion trap in other kinds of ion-manipulating processes utilizing resonant excitation of the ions. For example, when one or more kinds of ions each having a specific mass-to-charge ratio need to be selectively subjected to resonant excitation to generate product ions by collision-induced dissociation, a signal representing a frequency spectrum having a peak only at a specific frequency or over a specific frequency range can be used in place of the "broad-band signal representing a frequency spectrum having a notch at a specific frequency or over a specific frequency range."

Effect of the Invention

In the ion trap mass spectrometer according to the present invention, a number of unnecessary ions having different mass-to-charge ratios are simultaneously subjected to resonant excitation and removed from the ion trap in an ion-selecting process, such as precursor isolation. This ion selection does not require a long period of time as in the case where a frequency range is scanned for the resonant ejection. The unnecessary ions are quickly removed, after which the subsequent process (e.g. collision-induced dissociation) can be initiated. As a result, for example, the throughput of an MS/MS analysis is improved. More specifically, for example, the analysis time is expected to be as short as several tens of msec even when a high resolving power is required. Furthermore, even when the mass-to-charge ratio of the target ion to be selected is changed, the q value of the ion trap can be maintained at a constant level, whereby a decrease in the mass-separating power depending on the mass-to-charge ratio of the target ion can be prevented. Additionally, according to the present invention, the process of removing unnecessary ions for the purpose of precursor isolation is simultaneously performed within a predetermined mass-to-charge ratio range, so that unnecessary ions or the like will not remain in the ion trap without being removed. Furthermore, since it is unnecessary to prepare a large number of different kinds of waveform data for target ions over a broad mass-to-charge ratio range, the capacity of the memory for storing waveform data will be saved. The period of time required for generating waveform data will also be shortened.

BEST MODE FOR CARRYING OUT THE INVENTION

Figure 1:
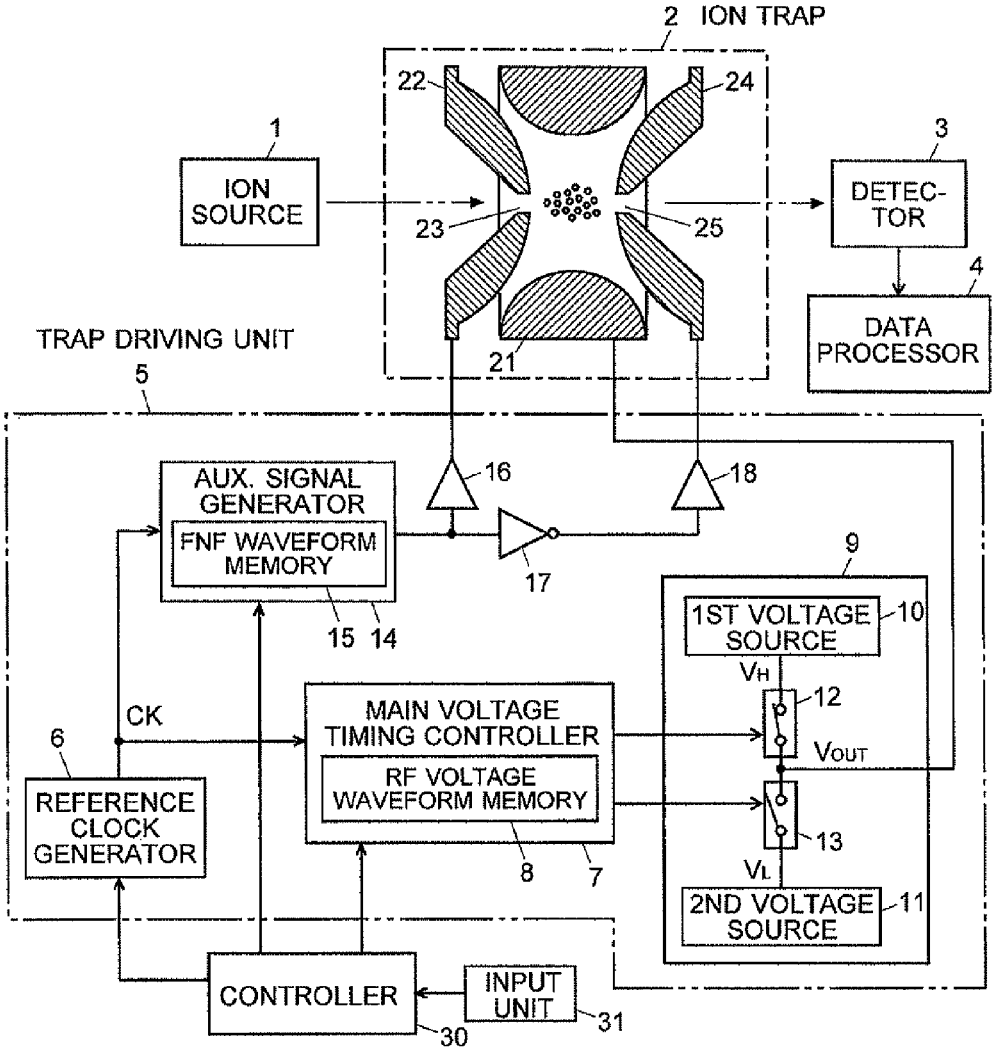
FIG. 1 is a configuration diagram showing the main components of a DIT-MS as one embodiment of the present invention.

A DIT-MS as one embodiment of the ion trap mass spectrometer according to the present invention is hereinafter described with reference to the attached drawings. FIG. 1 is a configuration diagram showing the main components of the ion trap used in the DIT-MS of the present embodiment.

The DIT-MS according to the present embodiment includes an ion source 1 for ionizing a target sample, a three-dimensional quadrupole ion trap 2 for temporarily holding ions and performing various operations on the ions, such as mass separation or collision-induced dissociation, a detector 3 for detecting the ions, and a data processor 4 for processing data obtained with the detector 3 so as to create, for example, a mass spectrum.

The ionization method used in the ion source 1 is not limited to any specific method. For liquid samples, an atmospheric pressure method is used, such as electrospray ionization (ESI) or atmospheric pressure chemical ionization (APCI). For solid samples, a matrix-assisted laser desorption ionization (MALDI) or similar method is used.

The ion trap 2 is composed of a ring electrode 21, an entrance end-cap electrode 22 and an exit end-cap electrode 24, with the two end-cap electrodes 22 and 24 facing each other across the ring electrode 21. The space surrounded by the three electrodes 21, 22 and 24 functions as an ion-capturing space. An ion injection hole 23 is bored substantially at the center of the entrance end-cap electrode 22. Ions emitted from the ion source 1 pass through this ion injection hole 23 to be introduced into the ion trap 2. On the other hand, an ion ejection hole 25 is bored substantially at the center of the exit end-cap electrode 24. Ions ejected from the ion trap 2 through this ion ejection hole 25 arrive at and are detected by the detector 3.

One example of the detector 3 is composed of a conversion dynode for converting incident ions into electrons and a secondary electron multiplier for multiplying and detecting electrons produced by the conversion dynode. Alternatively, a time-of-flight mass analyzer may be provided in place of the detector 3, in which case the ions stored in the ion trap 2 are collectively ejected through the ion ejection hole 25 into the time-of-flight mass analyzer, which separates and detects these ions with a high separating power according their mass-to-charge ratio.

The trap driving unit 5 for driving the ion trap 2 includes a reference clock generator 6, a main voltage timing controller 7, a main voltage generator 9, an auxiliary signal generator 14, and other components. The main voltage generator 9, which applies an ion-capturing rectangular-wave voltage to the ring electrode 21, includes a first voltage source 10 for generating a first voltage $V_H$, a second voltage source 11 for generating a second voltage $V_L$ ($V_L<V_H$), a first switch 12 and a second switch 13 both being serially connected between the output end of the first voltage source 10 and that of the second voltage source 11. The switches 12 and 13 are power MOSFETs or similar power switching elements capable of high-speed operation.

The main voltage timing controller 7 includes an RF voltage waveform memory 8. This controller 7 reads out RF voltage waveform data from the RF voltage waveform memory 8, generates two kinds of drive pulses (e.g. two complementary pulses) based on the read data, and supplies the pulses to the switches 12 and 13. When the first switch 12 is ON and the second switch 13 is OFF, the first voltage $V_H$ is outputted, Conversely, when the second switch 13 is ON and the first switch 12 is OFF, the second voltage $V_L$ is outputted. Accordingly, the output voltage $V_{OUT}$ of the main voltage generator 9 will ideally be a rectangular-wave voltage of predetermined frequency f alternating between the high level $V_H$ and low level $V_L$. Normally, $V_H$ and $V_L$ are high voltages having the same absolute value and opposite polarities. For example, their absolute value is within a range from several hundred volts to one kilovolt. The frequency f is typically within a range from several ten kHz to several MHz. The rectangular-wave voltage applied to the ring electrode 21 usually has a simple, repetitive waveform with a predetermined frequency. However, due to the use of the RF voltage waveform data stored in the RF voltage waveform memory 8, it is easy to arbitrarily set the duty ratio of that voltage or subtly adjust the timing of switching the two kinds of drive pulses to prevent simultaneous output of the two voltages.

Figure 2:
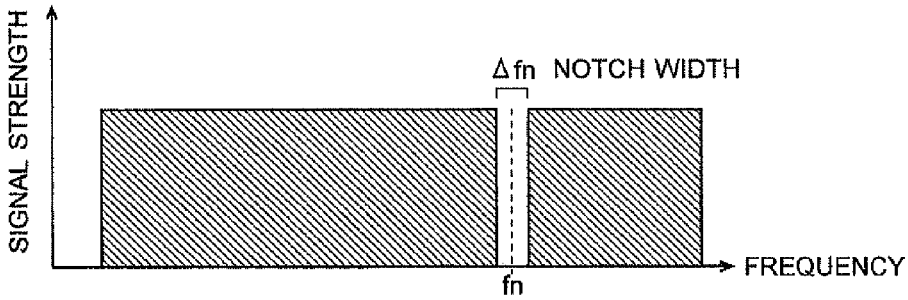
FIG. 2 is a schematic diagram showing the frequency spectrum of an FNF signal.

The auxiliary signal generator 14 includes an FNF waveform memory 15, a digital-to-analogue (D/A) converter (not shown) and other components. In the FNF waveform memory 15, a waveform data obtained by digitizing an FNF signal is stored. As shown in FIG. 2, the FNF signal represents a frequency spectrum which has a notch formed around a central frequency fn with a frequency width Δfn and further includes a large number of other frequency components. It should be noted that fn and Δfn are the frequency and frequency width with which an analogue FNF signal is generated. When the DIA conversion is performed with the same frequency as the frequency used for the analogue-to-digital (A/D) conversion of the aforementioned analogue FNF signal, the resulting signal will have a notch with the central frequency fn and the frequency width Δfn. When the D/A conversion is performed with a frequency equal to one half of the sampling frequency used in the A/D conversion of the analogue FNF signal, the central frequency of the notch will be fn/2.

That is to say, the central frequency of the notch of the FNF signal depends on the frequency of the clock signal used in the D/A conversion of the waveform data read from the FNF waveform memory 15. On the other hand, the frequency width of the notch of the FNF signal is independent of the frequency of the clock signal used in the D/A conversion. The frequency width of the notch corresponds to the mass-separation width. Therefore, if the frequency width of the notch remains unchanged for a change in the central frequency thereof, the mass-separation width will simultaneously change when the mass-to-charge ratio of the target ion is changed. When it is desirable to change the mass-to-charge ratio of the target ion while maintaining a constant mass-separation width, it is necessary to prepare a plurality of different kinds of FNF signal waveform data with the notch having the same central frequency and different frequency widths, and to select an appropriate waveform data for the required mass-separation width when generating the FNF signal.

The FNF signal generated by the auxiliary signal generator 14 is supplied through a drive circuit 16 to the entrance end-cap electrode 22 as well as through a reversing circuit 17 and a drive circuit 18 to the exit end-cap electrode 24. The reverse circuit 17 reverses the polarity of the FNF signal.

The reference clock generator 6 generates a reference clock signal CK having a continuously variable frequency. For example, a clock-generating circuit using a direct digital synthesizer (DDS) can be used as the reference clock generator 6. The reference clock signal CK is sent to the main voltage timing controller 7 and the auxiliary signal generator 14. In synchronization with this reference clock signal CK, the main voltage timing controller 7 and the auxiliary signal generator 14 perform the process of generating a rectangular-wave voltage and an FNF signal. The clock signals respectively supplied to the main voltage timing controller 7 and the auxiliary signal generator 14 do not need to have the same frequency and the same phase; the minimal requirement is to synchronize the two clock signals while maintaining their frequencies at a constant ratio. Accordingly, for example, it is possible to directly use the reference clock signal CK as one of the two clock signals, while generating the other clock signal by dividing the reference clock signal CK at a specific dividing ratio.

The setting of the frequency of the reference clock signal CK in the reference clock generator 6, the selection of an RF voltage waveform data used in the main voltage timing controller 7, the selection of an FNF waveform data used in the auxiliary signal generator 14, and other operations are controlled by a controller 30 composed of a CPU, ROM, RAM and other elements. An input unit 31 for allowing users to set analysis conditions or other information is connected to the controller 30.

An MS/MS analysis operation performed by the DIT-MS of the present embodiment is hereinafter described. Various kinds of ions produced by the ion source 1 are introduced through the ion injection hole 23 into the ion trap 2. Then, these ions are captured by an ion-capturing electric field, which is created within the ion trap 2 by applying a rectangular-wave voltage of a predetermined frequency from the main voltage generator 9 to the ring electrode 21 while maintaining each of the end-cap electrodes 22 and 24 at a constant voltage. Next, in accordance with the mass-to-charge ratio of a desired precursor ion and the mass-separation width specified through the input unit 31, the controller 30 sets the frequency of the reference clock signal CK generated by the reference clock generator 6. Meanwhile, in accordance with the specified mass-to-charge ratio and mass width, the main voltage timing controller 7 reads an appropriate RF voltage waveform data from the RF voltage waveform memory 8. Similarly, the auxiliary signal generator 14 reads an appropriate FNF signal waveform data.

The main voltage timing controller 7 supplies drive pulses to the main voltage generator 9 by sequentially and repeatedly sending the RF voltage waveform data based on the reference clock signal CK in the previously described manner. The main voltage generator 9 applies a rectangular-wave voltage to the ring electrode 21. Meanwhile, the auxiliary signal generator 14 generates an FNF signal by a D/A conversion of the FNF signal waveform data based on a clock signal synchronized with the reference clock signal CK and sends the generated signal to the end-cap electrodes 22 and 24.

A more specific example is as follows: The main voltage timing controller 7 generates drive pulses with a frequency of 2 MHz from a reference clock signal CK having a frequency of 100 MHz. In this case, the rectangular-wave voltage generated by the main voltage generator 9 also has a frequency of 2 MHz. Meanwhile, for the reference clock signal CK of 100 MHz, the auxiliary signal generator 14 generates an FNF signal having a notch with a predetermined width around a central frequency of 500 kHz based on the FNF signal waveform data. The value of 500 kHz in notch frequency corresponds to 0.5 in β value and 0.5 in q value. Under this condition, if the inscribing radius of the ion trap 2 is $r_0$=10 mm, ions centering on m/z50 will be isolated as a precursor. That is to say, ions near m/z50 remain within the ion trap 2 without being resonantly excited, while ions having the other mass-to-charge ratios are removed from the ion trap 2 due to resonant ejention.

Next, consider the case where the frequency of the reference clock signal CK has been lowered to $\sqrt{(1/60)}\approx 1/7.7$ of 100 MHz, which is approximately 13 MHz, in the reference clock generator 6. In this case, both the frequency of the rectangular-wave voltage generated by the main voltage generator 9 and the notch frequency of the FNF signal generated by the auxiliary signal generator 14 change in the same proportion and decrease to approximately 1/7.7 of the original level. Accordingly, the frequency of the rectangular-wave voltage applied to the ring electrode 21 will be approximately 260 kHz, and the notch frequency of the FNF signal will be approximately 65 kHz. However, the β value and the q value of the ion trap are maintained at approximately 0.5. Under this condition, only the ions having mass-to-charge ratios around m/z3000 remain in the ion trap 2 without being resonantly excited, while ions having the other mass-to-charge ratios are removed from the ion trap 2 by resonant ejection. In this process, if the same FNF signal waveform data as used in the previous case is used, the frequency width of the notch remains unchanged even through the frequency of the notch is lowered, which results in a substantial decrease in the mass-separation width. If the same mass-separation width should be maintained before and after the change in the mass-to-charge ratio of the target ion from m/z50 to m/z3000, it is necessary to read from the FNF waveform memory 15 another FNF signal waveform data in which the notch has a different frequency width.

In this manner, by arbitrarily setting the frequency of the reference clock signal CK generated in the reference clock generator 6 to a desired frequency within the range from 100 MHz to 13 MHz, an ion having a mass-to-charge ratio corresponding to that frequency can be selected as a precursor ion within the mass-to-charge ratio range from m/z50 to m/z3000. The resolving power of mass-to-charge ratio set for selecting ions depends on the frequency-resolving power of the reference clock generator 6. Accordingly, when the frequency of the reference clock signal CK is continuously variable, the mass-to-charge ratio of the target ion can be virtually freely set within the range from m/z50 to m/z3000.

After the precursor isolation for leaving only a target ion as the precursor ion is completed in the previously described manner, a CID gas is introduced into the ion trap 2 and a signal for resonantly exciting the remaining ion is applied to the end-cap electrodes 22 and 24 to dissociate the precursor ion. Subsequently, the product ions produced by dissociation are expelled for each mass-to-charge ratio by resonance ejection and detected by the detector 3.

Provided that the q value of the ion trap is constant, the relationship between the mass-to-charge ratio m/z of the target ion and the frequency Ω of the rectangular-wave voltage can be written as $m/z \square 1/\Omega^2$. This relationship can be used to calibrate the mass-to-charge ratio to be selected.

In practice, it is expected that a discrepancy from the aforementioned theoretical relationship occurs due to a mechanical dimension error of the electrodes 21, 22 and 24 constituting the ion trap 2, the accuracy of the RF waveform, or other factors. To address this problem, the relationship between the mass-to-charge ratio m/z of the target ion and the frequency Ω of the rectangular-wave voltage may be expressed by a polynomial equation, for example, as follows:

$$m/z=1/(\alpha\Omega^2+\beta\Omega+\gamma).$$

The values of the coefficients α, β and γ can be calculated from a plurality of calibration points (of known relationships between mass-to-charge ratio m/z and frequency Ω). The obtained coefficient values can be used to perform the aforementioned calibration.

Although the previously described system used an FNF signal as the signal waveform for resonant excitation, this is not the only possible choice and any signal waveform may be used as long as the waveform has a notch within a specific frequency range and includes a large number of other frequency components. As for the method for generating a notched broad-band signal used for creating data to be stored in the FNF signal memory 15, it is naturally possible to use any of a variety of conventional methods.

Although the ion trap used in the previous embodiment was a three-dimensional quadrupole ion trap, it is obvious that the present invention can be applied to an ion trap mass spectrometer using a liner ion trap capable of capturing ions and ejecting them by resonant excitation on the same principle, and thereby achieve the previously described effects.

EXPLANATION OF NUMERALS

1 . . . Ion Source
2 . . . Ion Trap
  21 . . . Ring Electrode
  22 . . . Entrance End-Cap Electrode
  23 . . . Ion Injection Hole
  24 . . . Exit End-Cap Electrode
  25 . . . Ion Ejection Hole
3 . . . Detector
4 . . . Data Processor
5 . . . Trap Driving Unit
6 . . . Reference Clock Generator
7 . . . Main Voltage Timing Controller
8 . . . RF Voltage Waveform Generator
9 . . . Main Voltage Generator
10 . . . First Voltage Source
11 . . . Second Voltage Source
12 . . . First Switch
13 . . . Second Switch
14 . . . Auxiliary Signal Generator
15 . . . FNF Waveform Memory
16, 18 . . . Drive Circuit
17 . . . Reversing Circuit
30 . . . Controller

The invention claimed is:

1. An ion trap mass spectrometer having an ion trap for capturing ions into a space surrounded by three or more electrodes including a first electrode, a second electrode and a third electrode, the second electrode and the third electrode facing each other apart from the first electrode, the mass spectrometer capable of resonant ejection of unnecessary ions from among the captured ions by applying a signal for resonant excitation of ions to each of the second and third electrodes while applying an ion-capturing rectangular-wave voltage to the first electrode, comprising:

a) a data memory for storing a waveform data obtained by digitizing a broad-band signal representing a frequency spectrum having a notch at a predetermined frequency or over a predetermined frequency range;

b) a rectangular-wave voltage generator for generating, in an ion-selecting process for selectively leaving an ion having a specific mass-to-charge ratio or ions belonging to a specific mass-to-charge ratio range in the ion trap, an ion-capturing rectangular-wave voltage adjusted to a frequency corresponding to the aforementioned specific mass-to-charge ratio or mass-to-charge ratio range, and for applying this rectangular-wave voltage to the first electrode; and c) a broad-band signal generator for generating a broad-band signal for resonantly exciting ions, excluding at least the ion having the specific mass-to-charge ratio or the ions belonging to the mass-to-charge ratio range, by sequentially retrieving waveform data stored in the data memory and converting the retrieved data to analogue data at a timing synchronized with the frequency of the rectangular-wave voltage generated by the rectangular-wave voltage generator in the ion-selecting process, and for applying the broad-band signal to the second and third electrodes.

2. The ion trap mass spectrometer according to claim 1, further comprising a reference clock signal generator for generating a reference clock signal having a frequency corresponding to the mass-to-charge ratio of an ion or the mass-to-charge ratio range of ions to be left in the ion trap in the ion-selecting process, wherein:

the rectangular-wave voltage generator generates a rectangular-wave voltage on a basis of the reference clock signal; and the broad-band signal generator generates a broad-band signal by digitizing a waveform data read from the data memory in accordance with the reference clock signal or another clock signal synchronized with the reference clock signal.

* * * * *